US009617045B2

(12) United States Patent
Reinders

(10) Patent No.: US 9,617,045 B2
(45) **Date of Patent: *Apr. 11, 2017**

(54) CAP, CAP/CONTAINER COMBINATION

(71) Applicant: Robert C. Reinders, Las Vegas, NV (US)

(72) Inventor: Robert C. Reinders, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/898,955

(22) Filed: May 21, 2013

(65) Prior Publication Data

US 2013/0270270 A1 Oct. 17, 2013

Related U.S. Application Data

(63) Continuation of application No. 13/464,485, filed on May 4, 2012, now Pat. No. 8,443,999.

(Continued)

(51) Int. Cl.

| | |
|---|---|
| ***B65D 41/34*** | (2006.01) |
| ***B65D 75/58*** | (2006.01) |
| ***B65D 41/04*** | (2006.01) |

(52) U.S. Cl.

CPC ..... *B65D 41/34* (2013.01); *B65D 41/0485* (2013.01); *B65D 41/3409* (2013.01); *B65D 75/5883* (2013.01); *B65D 2213/00* (2013.01)

(58) Field of Classification Search

CPC B65D 2213/00; B65D 41/34; B65D 75/5883; B65D 41/0485; B65D 41/3409

(Continued)

(56) References Cited

U.S. PATENT DOCUMENTS 2,643,789 A * 6/1953 Theobald, Sr. ..... B65D 51/28 206/216
3,259,233 A * 7/1966 Beeman ..... B65D 41/3447 220/214

(Continued)

FOREIGN PATENT DOCUMENTS

| | | |
|---|---|---|
| DE | 29609596 | 10/1996 |
| EP | 1065150 | 3/2001 |

(Continued)

OTHER PUBLICATIONS

FDA Tamper Resistant Packaging Guide "FDA Compliance Policy Guides Section 450.500 Tamper Resistant Packaging Requirements" revised May 21, 1992, 6 pages.

(Continued)

*Primary Examiner* — James N Smalley
(74) *Attorney, Agent, or Firm* — Thomas D. Wilhelm; Northwind IP Law, S.C.

(57) ABSTRACT

Caps, containers embodying such caps, and methods of enhancing cap safety. Air flow passages through the cap enable one, who accidentally swallowed the cap, to breathe/pass air through the cap. Some air passages extend top to bottom. Openings in the outer side wall, and an air flow path across the cap, allow air to enter the cap on a first side, flow transversely through the cap, and exit an opposing side. The top-to-bottom air flow passages, and the air flow path across the cap, including the openings in the outer wall of the cap, collectively support air flow through the cap, thus through the person's airway, if/when the cap becomes accidentally lodged in a person's airway. The openings can be used to engage and extract an accidentally swallowed cap. Elements of an optional tamper evident ring remain attached to the cap after the cap is removed from the container.

27 Claims, 10 Drawing Sheets

Related U.S. Application Data

(60) Provisional application No. 61/624,664, filed on Apr. 16, 2012.

(58) Field of Classification Search
USPC ..... 215/250, 334, 337, 253, 252, 243; 220/203.13, 253, 252, 288; 53/420
See application file for complete search history.

(56) References Cited

U.S. PATENT DOCUMENTS

| | | | | | |
|---|---|---|---|---|---|
| 3,304,039 | A * | 2/1967 | Edelman | A47K 1/09 | 206/806 |
| 3,601,273 | A * | 8/1971 | Kutcher | 215/252 | |
| 3,812,991 | A * | 5/1974 | Wurl | 215/252 | |
| 4,206,851 | A * | 6/1980 | Ostrowsky | 215/246 | |
| 4,270,664 | A * | 6/1981 | Buono | B65D 50/046 | 215/216 |
| 4,280,631 | A * | 7/1981 | Lohrman | B65D 50/046 | 215/204 |
| 4,305,516 | A | 12/1981 | Perne et al. | | |
| 4,358,031 | A * | 11/1982 | Lohrman | B65D 50/046 | 215/216 |
| 4,418,828 | A * | 12/1983 | Wilde et al. | 215/252 | |
| 4,530,436 | A * | 7/1985 | Wiedmer | 215/246 | |
| 4,565,293 | A * | 1/1986 | Jonas | 215/246 | |
| 4,572,387 | A * | 2/1986 | Luker et al. | 215/252 | |
| 4,669,124 | A | 5/1987 | Kimura | | |
| 4,805,792 | A * | 2/1989 | Lecinski, Jr. | 215/253 | |
| 4,899,898 | A * | 2/1990 | Thompson | 215/252 | |
| 5,044,530 | A * | 9/1991 | Stull | B65D 47/242 | 222/521 |
| 5,048,730 | A * | 9/1991 | Forsyth et al. | 222/482 | |
| 5,051,015 | A * | 9/1991 | Moeck | 401/202 | |
| 5,056,675 | A * | 10/1991 | Julian | 215/252 | |
| 5,080,246 | A * | 1/1992 | Hayes | 215/252 | |
| 5,203,637 | A * | 4/1993 | Nishimura et al. | 401/202 | |
| 5,251,769 | A * | 10/1993 | Battegazzore | 215/252 | |
| 5,295,600 | A * | 3/1994 | Kowal | 215/252 | |
| 5,346,082 | A * | 9/1994 | Ochs et al. | 215/252 | |
| 5,353,970 | A * | 10/1994 | Stull | B65D 47/242 | 222/521 |
| 5,480,044 | A * | 1/1996 | Nosser | 215/228 | |
| 5,512,047 | A * | 4/1996 | Dvorak | 604/77 | |
| 5,676,269 | A * | 10/1997 | Blake et al. | 215/252 | |
| 5,716,152 | A | 2/1998 | Kudo | | |
| 5,725,115 | A * | 3/1998 | Bosl et al. | 215/252 | |
| 5,740,932 | A * | 4/1998 | Battegazzore | 215/252 | |
| 5,836,468 | A * | 11/1998 | Bosl et al. | 215/253 | |
| 5,853,095 | A * | 12/1998 | Marshall et al. | 215/252 | |
| 5,992,661 | A * | 11/1999 | Zumbuhl | 215/252 | |
| 6,024,256 | A | 2/2000 | Beck et al. | | |
| 6,116,443 | A * | 9/2000 | Parrinello | 215/252 | |
| 6,202,871 | B1 * | 3/2001 | Kelly | 215/307 | |
| 6,264,052 | B1 * | 7/2001 | Schmitz | 215/252 | |
| 6,325,227 | B1 * | 12/2001 | Ekkert | 215/252 | |
| 6,811,047 | B1 | 11/2004 | Hicks et al. | | |
| 7,891,510 | B2 * | 2/2011 | Loughrin et al. | 215/252 | |
| 8,443,999 | B1 * | 5/2013 | Reinders | 220/303 | |
| 2004/0200797 | A1 * | 10/2004 | Hicks et al. | 215/305 | |
| 2005/0006334 | A1 * | 1/2005 | Luker | 215/334 | |
| 2005/0011911 | A1 | 1/2005 | Vaughan | | |
| 2005/0045578 | A1 * | 3/2005 | Schwarz et al. | 215/252 | |
| 2005/0165351 | A1 * | 7/2005 | Tamagni, Jr. | 604/77 | |
| 2006/0000793 | A1 * | 1/2006 | Mavin et al. | 215/253 | |
| 2006/0043056 | A1 | 3/2006 | Lee | | |
| 2006/0060555 | A1 * | 3/2006 | Ma et al. | 215/252 | |
| 2007/0164058 | A1 * | 7/2007 | Burkovskiy | 222/566 | |
| 2009/0120936 | A1 * | 5/2009 | Zauser et al. | 220/257.1 | |
| 2009/0223963 | A1 * | 9/2009 | Bisio | 220/304 | |
| 2009/0301986 | A1 * | 12/2009 | Phelan et al. | 215/252 | |
| 2010/0126997 | A1 * | 5/2010 | Stull et al. | 220/281 | |
| 2011/0005521 | A1 * | 1/2011 | Scarrott et al. | 128/203.12 | |

FOREIGN PATENT DOCUMENTS

| | | | | |
|---|---|---|---|---|
| EP | 1407977 | | 4/2004 | |
| EP | 1407977 | A1 * | 4/2004 | B65D 51/18 |
| JP | 08198286 | | 8/1996 | |
| JP | 2004331124 | | 11/2004 | |
| JP | 2004331124 | A * | 11/2004 | B65D 41/34 |
| WO | 02092452 | | 11/2002 | |
| WO | 2011054028 | | 5/2011 | |

OTHER PUBLICATIONS

Petition for Inter Partes Review by KSP of U.S. Pat. No. 8,528,757 dated May 19, 2016, 80 pages.

* cited by examiner

CAP, CAP/CONTAINER COMBINATION

CROSS-REFERENCE TO RELATED APPLICATIONS

This application is a continuation of application Ser. No. 13/464,485, filed May 4, 2012, which is a Non-Provisional of Application Ser. No. 61/624,664, filed Apr. 16, 2012, the complete disclosures of both of which are incorporated herein by reference in their entireties.

BACKGROUND OF THE INVENTION

This invention relates to caps which are adapted to be mounted on containers. Typical such caps have threads which engage corresponding threads on a coupling portion of the container. Such cap may, or may not, include tamper evident structure which provides an indication that the cap has been removed from the container, thus to indicate that the contents of the container have been compromised to outside input.

For example, single service bottles of drinkable liquid and/or food may include such tamper evident structure.

This invention is directed especially at caps which are sized to fit onto bottles and/or pouches where the coupling portion of the container can be used as a dispenser to dispense the container contents directly into the mouth of a user of such contents.

The invention is also directed to containers which are used to contain food products for use by infants and small children, including such containers which may be produced in large quantities on highly-automated machinery, or which may be produced on less automated machinery with the supplement of additional manual labor.

In containers intended for the above uses, it can be important that the container and/or the cap provide some indication that the seal on the container has been broken and/or at least that an initial cap removal has occurred.

It is also important that such caps not pose a choking hazard to the user, e.g. a small child, once the cap has been removed from the container.

A variety of caps have been proposed which include tamper evident structure. Representative of such teachings is U.S. Pat. No. 5,853,095 Marshall et al. Marshall at al teach a cap having a tamper evident, transversely-extending ring, which has an axially-extending split line 46 internal to the ring which separates one segment of the ring from the other, and a plurality of axially-extending breakable bridges 42 which also break when the cap is disconnected from the bottle.

US Published Patent Application 2009/0023963 Bisio teaches a cap which has both tamper evident structure as "guarantee seal 10" and "safety passages 21" which allow passage of air through the cap, top-to-bottom "if the cap is accidentally swallowed". However, if swallowed, such cap will find the path of least resistance in the person's airway. In so doing, the cap will likely become turned such that the sides of the cap face in the axial direction, thus minimizing the cross-section of the cap when viewed along the axial length of the airway. In such orientation, the cap of Bisio has no provision for passage of air through such cap which is in a person's airway.

Further, no cap known to Applicant has an outer wall for manipulation by the user, an inner wall for engaging a coupling on a container and a tamper evident ring where the diameter of the bottom of the inner wall is at least as great as the diameter of the tamper evident ring, such that the bottom of the inner wall supports the tamper evident ring against axial loads imposed from below the bottom of the cap.

The applicant is not aware of any cap which facilitates the positioning of machine fingers which engage and tighten the cap on the coupling or bottle.

The applicant herein is not aware of any cap which has an outer surface of an outer wall which is textured to facilitate manual or machine handling and/or transport of the respective cap, or container onto which the cap has been mounted.

Further, the applicant herein is not aware of any cap whose structure facilitates removal of the cap from a patient's throat/airway after the cap has been swallowed.

Accordingly, there is a need for caps which facilitate the positioning of machine-mounted tightening fingers.

There is also a need for caps which use a minimum number of frangible/breaking elements so as to minimize the number of broken ends which might injure a user.

There is further a need for caps which provide for passage of air through the cap if the cap is accidentally swallowed, irrespective of the orientation of the cap in the person's airway.

There is also a need for caps which have tamper evident structure which remains attached to such cap when such cap is disconnected from the container, because such attached tamper evident structure serves as an incremental further hindrance to swallowing such caps.

There is still further a need for caps where the bottom of the inner wall supports a tamper evident ring against axial loads imposed from below the bottom of the cap.

There is also a need for a cap whose structure is textured and otherwise designed to facilitate manual and/or machine handling and/or transport of the respective cap, or container onto which the cap has been mounted.

There is further a need for a cap which facilitates, by its design, removal of the cap from a patient's throat/airway after the cap has been swallowed.

There is also a need for a method of reducing risk of a person not being able to breathe after accidentally swallowing a cap, irrespective of any orientation of the cap in the person's airway.

These and other needs are alleviated, or at least attenuated, or partially or completely satisfied, by novel products and methods of the invention.

SUMMARY OF THE INVENTION

This invention provides caps for containers, and containers embodying such caps. Such cap has air flow passages which enable a user, who may have accidentally swallowed such cap and lodged such cap in the airway, to breathe/pass enough air through such swallowed cap to at least temporarily sustain life.

The cap typically has air passages which pass through the cap between the top and the bottom of the cap. The cap further has openings in the outer side wall of the cap, and an air flow path across the cap such that, if/when the cap becomes lodged in the airway, air can enter the cap on a first side of the cap through the openings in the outer wall, flow across the cap along an air flow path, and exit the cap at an opposing second side of the cap.

As a result of the top-to-bottom air flow passages, and the air flow path across the cap, including the openings in the outer side wall of the cap, the cap can support flow of air through the cap, and thus through the user's airway, if/when the cap becomes accidentally lodged in a user's airway.

Ring elements of an optional tamper evident ring remain attached to the cap after the cap is removed from the container, contributing to the difficulty of accidentally swallowing the cap.

In a first family of embodiments, the invention comprehends a cap adapted to be mounted to a receptive portion of a container and to be disconnected from such receptive portion of such container, the cap having a top and a bottom, and an outer perimeter, and comprising an outer wall, the outer wall having a top and a bottom, and an inner surface and an outer surface, and having an outer perimeter consistent with the outer perimeter of the cap; an inner wall extending between the bottom of the cap and the top of the cap, the outer wall extending about the inner wall; at least one connector connecting the outer wall and the inner wall to each other; at least a first axial passage extending entirely through the cap, from the top of the cap to the bottom of the cap; and a plurality of openings spaced about the outer perimeter of the outer wall, and extending between the inner and outer surfaces of the outer wall, the plurality of openings being located between the top of the outer wall and the bottom of the outer wall, and defining passages which can convey air between the inner and outer surfaces of the outer wall.

In some embodiments, the cap further comprises a cross-cap path across the cap enabling air to flow between one or more of the openings on a first side of the cap, along the cross-cap path to respective one or more of the openings on an opposing second side of the cap, such that air can flow through the cap by entering the cap through the outer wall on the first side of the cap, flowing along the cross-cap path across the cap, and leaving the cap through the outer wall at the second opposing side of the cap.

In some embodiments, sizes and spacings of the openings through the outer wall, in combination with the cross-cap path can, collectively, convey such volume of air at breathing pressure as to enable a person, who may have swallowed the cap, to at least temporarily breathe enough air through such openings and along the cross-cap path, and thus through the cap, to at least temporarily sustain life.

In some embodiments, that at least one connector has a connector top consistent with the top of the cap, the top of at least one such connector being recessed from the top of the cap, the cross-cap path passing over the top of the at least one recessed connector and between the top of the at least one recessed connector and the top of the cap.

In some embodiments, the cap comprises a cap body, further comprising a tamper evident ring proximate the bottom of the cap and connected to the cap body, the tamper evident ring comprising at least one ring element which breaks when the cap is disconnected from such receptive portion of such container, thus to indicate that the container has been opened.

In some embodiments, the tamper evident ring has a first outer annular circumference, the inner wall of the cap body has a top and a bottom, and a second outer annular circumference at the bottom of the inner wall, adjacent the tamper evident ring, greater than the first outer annular circumference of the tamper evident ring.

In some embodiments, the cap further comprises an aperture in at least one connector, at least an element of the cross-cap path passing through such aperture in the at least one connector.

In some embodiments, the invention comprehends a container, comprising an inner receptacle, a coupling adapted for dispensing contents of the receptacle, and a cap of the invention mounted to the coupling and thereby closing off the receptacle from the ambient environment.

In a second family of embodiments, the invention comprehends a cap adapted to be mounted to a receptive portion of a container and to be disconnected from such receptive portion of such container, the cap having a top and a bottom, and an outer perimeter, and comprising an outer wall, the outer wall having a top and a bottom, and an inner surface and an outer surface, and having an outer perimeter consistent with the outer perimeter of the cap; an inner wall extending between the bottom of the cap and the top of the cap, the outer wall extending about the inner wall; at least one connector connecting the outer wall and the inner wall to each other; at least a first axial passage extending entirely through the cap, from the top of the cap to the bottom of the cap; and a plurality of openings spaced about the outer perimeter of the outer wall, and extending between the inner and outer surfaces of the outer wall, including one or more such openings extending as a recess from one or more of the top or the bottom of the outer wall, the plurality of openings defining passages which can convey air between the inner and outer surfaces of the outer wall when passage of air is otherwise blocked off across the respective top or bottom of the cap.

In some embodiments the cap comprises a cap body, further comprising a tamper evident ring proximate the bottom of the cap and connected to the cap body, the tamper evident ring comprising at least one ring element which breaks when the cap is disconnected from such receptive portion of such container thus to indicate that the container has been opened, and the tamper evident ring being connected to the cap by one or more ring-to-cap connecting elements, all of the ring-to-cap connecting elements remaining connected to both the cap and the ring when the cap is disconnected from the receptive portion.

In a third family of embodiments, the invention comprehends a cap adapted to be mounted to a receptive portion of a container and to be disconnected from such receptive portion of such container, wherein such receptive portion comprises at least one resistant element which engages the cap when the cap is being disconnected from such receptive portion of such container, the cap having a top and a bottom, and comprising a cap body, the cap body comprising an outer wall, and an inner wall extending between the bottom of the cap and the top of the cap, the outer wall extending about the inner wall; and a tamper evident ring proximate the bottom of the cap, the tamper evident ring comprising one or more ring elements, each such ring element being connected to the cap body by one or more ring retaining tabs, ends of the ring elements being connected to each other by frangible intra-ring connecting bridges which break when the cap is disconnected from such receptive portion thereby to define, at each broken bridge, first and second ring element ends, at least one of the adjacent ring element ends on opposing ends of a broken bridge, after such breakage, being proximate a ring retaining tab, the other of the ring element ends being sufficiently remote from all the ring retaining tabs, on the respective ring element, that no ring retaining tab precludes movement of the respective ring element end relative to a remainder portion of the respective ring element.

In some embodiments, the outer wall has inner and outer surfaces, the cap further comprising a plurality of openings spaced about the outer perimeter of the outer wall, and extending through the outer wall between the inner and outer surfaces of the outer wall, the plurality of openings defining passages which can convey air between the inner and outer surfaces of the outer wall.

In some embodiments, the invention further comprises a cross-cap path across the cap enabling air to flow between one or more of the openings on a first side of the cap, along the cross-cap path to respective one or more of the openings on an opposing second side of the cap, such that air can flow through the cap by entering the cap through the outer wall on the first side of the cap, flowing along the cross-cap path across the cap, and leaving the cap through the outer wall at the second opposing side of the cap.

In a fourth family of embodiments, the invention comprehends a cap adapted to be mounted to a receptive portion of a container and to be disconnected from such receptive portion of such container, wherein such receptive portion comprises at least one resistant element which engages the cap when the cap is being disconnected from such receptive portion of such container, the cap having a top and a bottom, and comprising a cap body, the cap body comprising an outer wall, an inner wall, the inner wall having a top and a bottom, and extending between the bottom of the cap and the top of the cap, the outer wall extending about the inner wall, and at least first and second connectors extending between the top and the bottom of the cap and connecting the outer wall and the inner wall to each other; a tamper evident ring proximate the bottom of the cap and connected to the cap body, the tamper evident ring comprising at least one ring element which breaks when the cap is disconnected from such receptive portion of such container, thus to indicate that the container has been opened, the tamper evident ring having a first outer annular circumference, the inner wall having a second outer annular circumference at the bottom of the inner wall, adjacent the tamper evident ring, greater than the first outer annular circumference of the tamper evident ring; and at least a first passage extending entirely through the cap, from the top of the cap to the bottom of the cap, between the outer wall and the inner wall, at all times.

In some embodiments, the at least first and second connectors extend along arcuate paths between the inner wall and the outer wall.

In some embodiments, each ring element is connected to the cap body by a single ring retaining tab which remains connected to the cap body when the cap is disconnected from such receptive portion of such container, ends of the one or more ring elements being connected to each other by frangible intra-ring bridges which break, as such breakage of the ring elements, when the cap is disconnected from such receptive portion.

In some embodiments, the tamper evident ring is connected to the cap body by one or more ring-to-cap body connecting elements, all of the ring-to-cap body connecting elements remaining connected to both the cap body and the ring when the cap is disconnected from such receptive portion.

In some embodiments, the invention comprehends a container, comprising an inner receptacle, a coupling adapted for dispensing contents of the receptacle, and a cap having such tamper evident ring mounted to the coupling and thereby dosing off the receptacle from the ambient environment.

Figure 1:
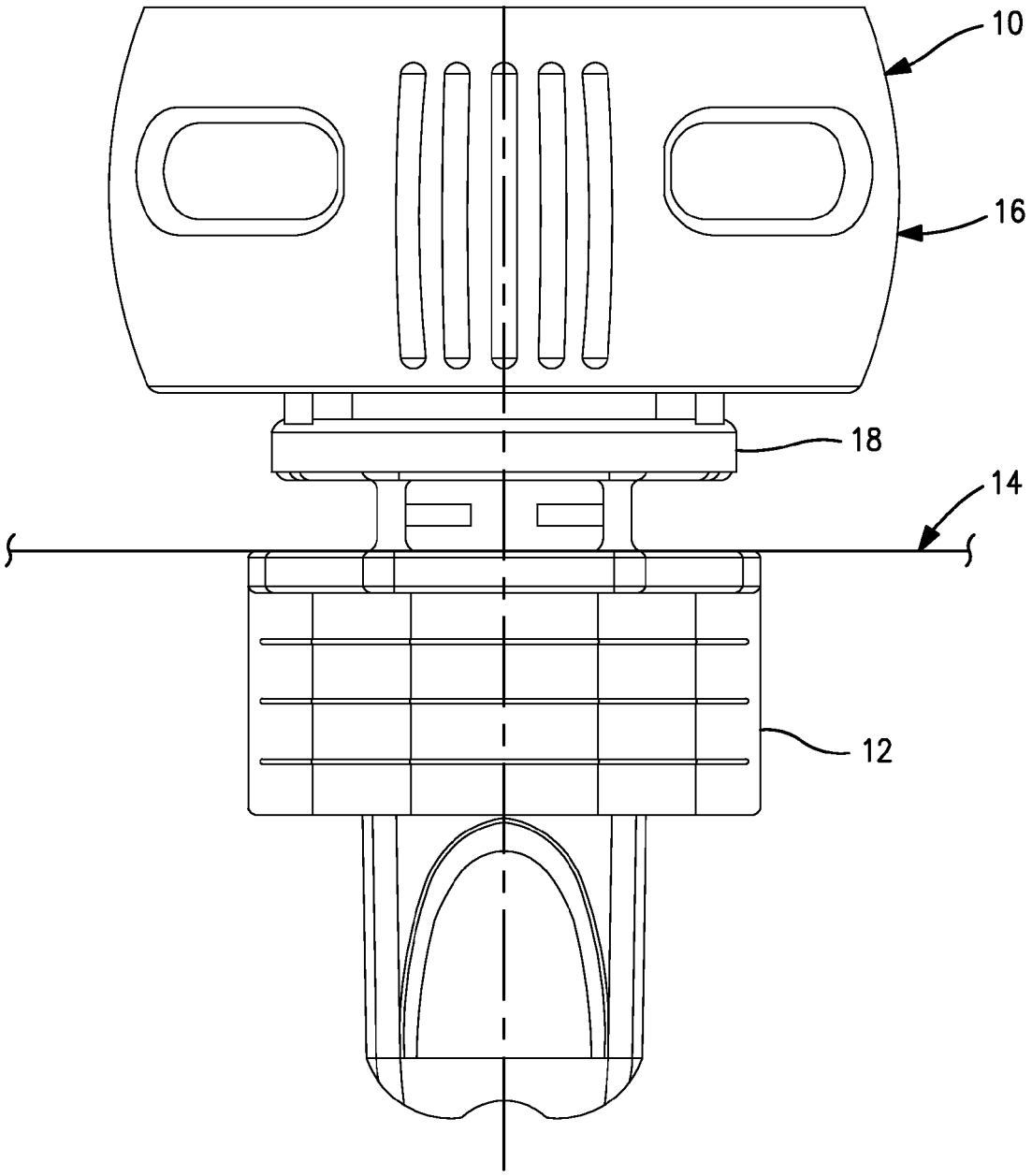
FIG. 1 shows a cap of the invention mounted on a coupling portion of a container, where the tamper evident ring is intact, before the designed breakage of the tamper evident ring when the cap is removed from the coupling.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 generally illustrates a cap 10 mounted to a receptive portion 12 of a container generally indicated as 14.

Exemplary of containers 14 which are contemplated, and so illustrated in FIG. 1, is a wide variety of containers including water bottles, juice bottles, juice boxes, pouches including retort pouches, plastic and metal cans, bags, squeezable tubes, and the like. Such container has an outer surface facing the ambient environment, and an inner surface facing an internal space/cavity/receptacle which is used to contain and protect a content which is intended to ultimately be dispensed for use by a user.

Receptive portion 12 may be part of container 14 per se, or can be a separate element which is separately mounted to the container. An example of a receptive portion 12 which is part of the container per se is the neck, collar, and threaded portion of a single-serving bottle of bottled water. An example of a receptive portion 12 which is separately mounted to the container is a coupling which is mounted, such as by heat sealing, to e.g. the flexible laminate structure which makes up the side walls of a retort pouch-type package. Thus, the receptive portion can be part of the package per se, or can be a separate element which is separately incorporated into the package during package assembly. The function of the receptive portion is to provide a secure connection between the internal space cavity/receptacle inside the container and the outside environment.

Referring to FIGS. 2-7, cap 10, generally made of moldable thermoplastic material, generally has a cap body 16 and a tamper evident ring 18. Cap body 16 has a top 20 and a bottom 22, an outer wall 24, an inner wall 26, and a plurality of connectors such as connecting tongues 28 which connect the outer wall to the inner wall. A plurality of air passages 30 extend through the cap, from the top of the cap to the bottom of the cap.

Outer wall 24 has a top 32, a bottom 34, and an outer perimeter 36 which corresponds to the outer perimeter of the cap body. As seen in e.g. FIG. 7, the outer wall outer perimeter can have a solid continuous rim in a single plane at at least one of top 32 or bottom 34 of the outer wall. Outer wall 24 further has an outer surface 38 and an inner surface 40.

A plurality of openings 42 are spaced about the outer perimeter of the outer wall. Openings 42 extend through the outer wall between the inner and outer surfaces of the outer wall, and are bounded on all sides by the outer wall, and thus provide paths for passage of air through the outer wall at openings 42.

Figure 7:
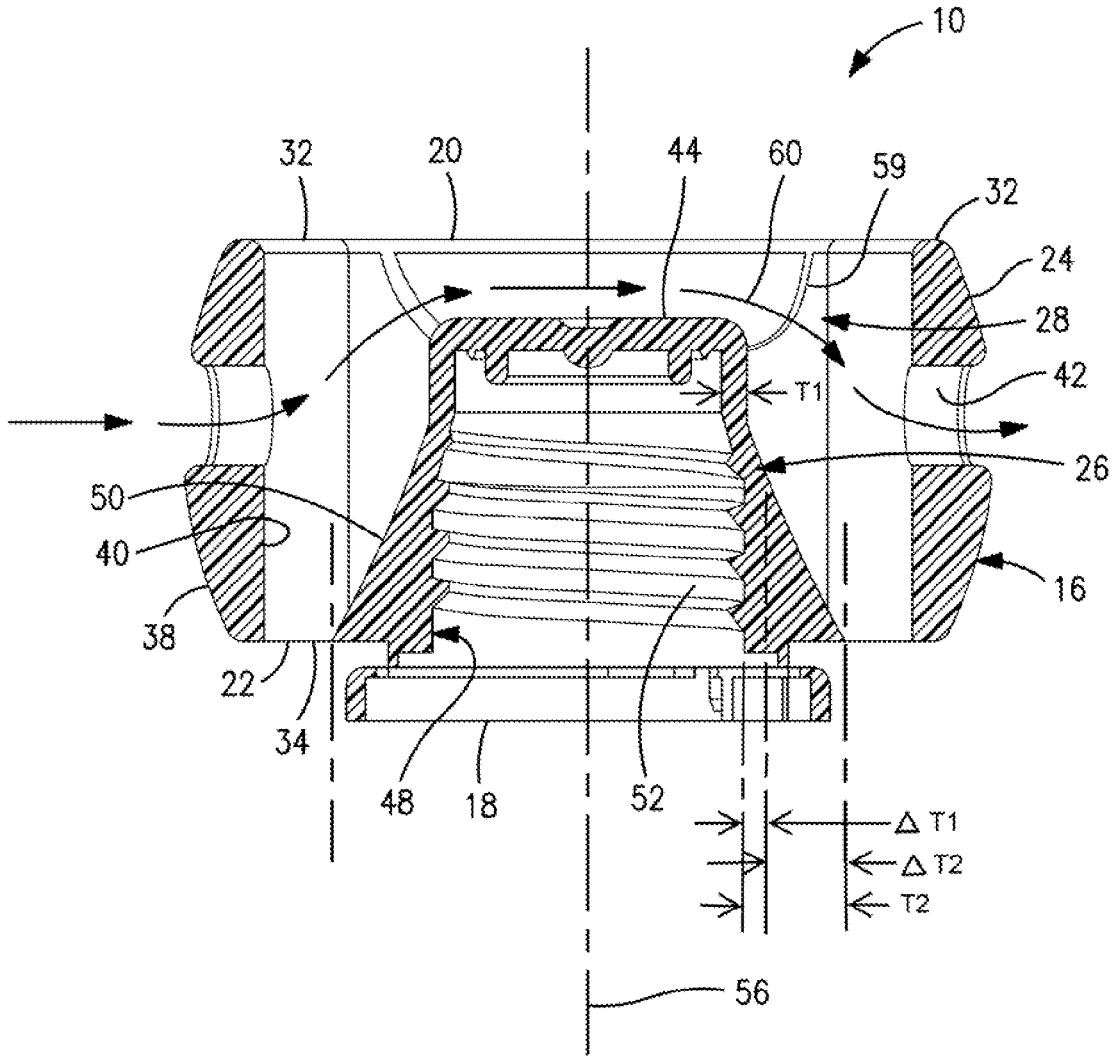
FIG. 7 is a cross-section of the cap, taken at 7-7 of FIG. 6.

Inner wall 26 has a top 44 and a bottom 46, an inner surface 48, and an outer surface 50. Inner surface 48 has threads 52 which define a thread-engaging portion of the inner surface of the inner wall, the thread-engaging portion having a top and a bottom, and interacting with a corresponding thread-engaging portion (not shown) on receptive portion 12. Outer surface 50 of the inner wall is tapered, expanding outwardly in a generally conical configuration from an upper portion of the inner wall to a bottom portion of the inner wall as readily seen in FIG. 7. The inner wall has a first radially-extending thickness increment T1. Thickness increment T1 defines a generally constant thickness, which extends from the inner surface of the inner wall to the outer surface of the inner wall, and extends from the top of the inner wall to the bottom of the inner wall. A second, variable-magnitude thickness increment T2, extends from approximately the bottom of the inner wall upwardly to approximately the top of the thread-engaging portion of the inner surface of the inner wall. Second thickness increment T2 comprises a constant-thickness lower portion ΔT1 of the first thickness increment T1, plus a variable thickness increment expressed in FIG. 7 as ΔT2. The thickness increment ΔT1 at the bottom of the inner wall is between the inner surface of the inner wall and the variable thickness increment ΔT2. As seen in FIG. 7, the top of the variable thickness increment T2 is substantially displaced from both the top of the inner wall and the bottom of the inner wall, at approximately the top of the thread-engaging portion of the inner surface of the inner wall; and the second variable thickness increment T2 and extends along at least one third of the top-to-bottom height of the inner wall, and extends, from the top of the variable thickness increment to approximately the bottom of the inner wall, in progressively increasing magnitudes of thickness.

Connecting tongues 28 extend from the inner wall to the outer wall, and thus provide a structural connection between the inner wall and the outer wall. The bottom plan view shown in FIG. 3 and the top plan view shown in FIG. 6 highlight the curvature of connecting tongues 28. A given arcuate tongue, when viewed in plan view, defines substantially the same magnitude of angle with respect to both the inner wall and the outer wall where the tongue connects to the respective inner and outer walls, though such symmetry is not a limitation of the invention.

Figure 3:
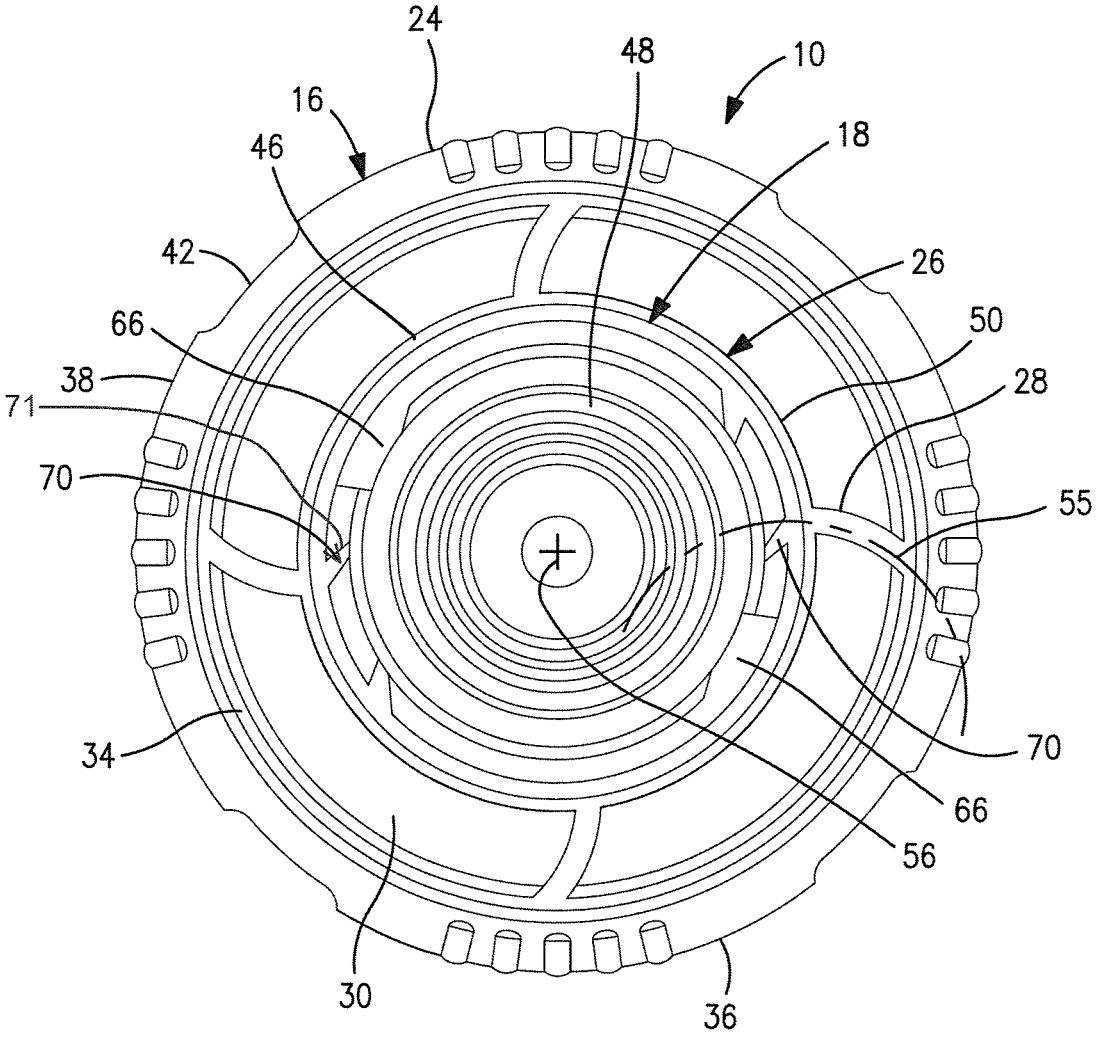
FIG. 3 is a bottom plan view of the cap of FIG. 2.

As illustrated in FIG. 3, a centerline 55 of an imaginary arc, extending longitudinally along tongues 28, by-passes the central longitudinal axis 56 of the cap. As illustrated in the top plan view of FIG. 6, the curved, arcuate configurations of the tongues, equidistantly spaced about the circumference of the cap, urge tightening fingers 58 (shown in dashed outline), of a cap tightening machine, toward a central location generally equidistant between the top of inner wall 26 and the top of outer wall 24, thus generally assisting with final positioning of fingers 58.

Figure 5:
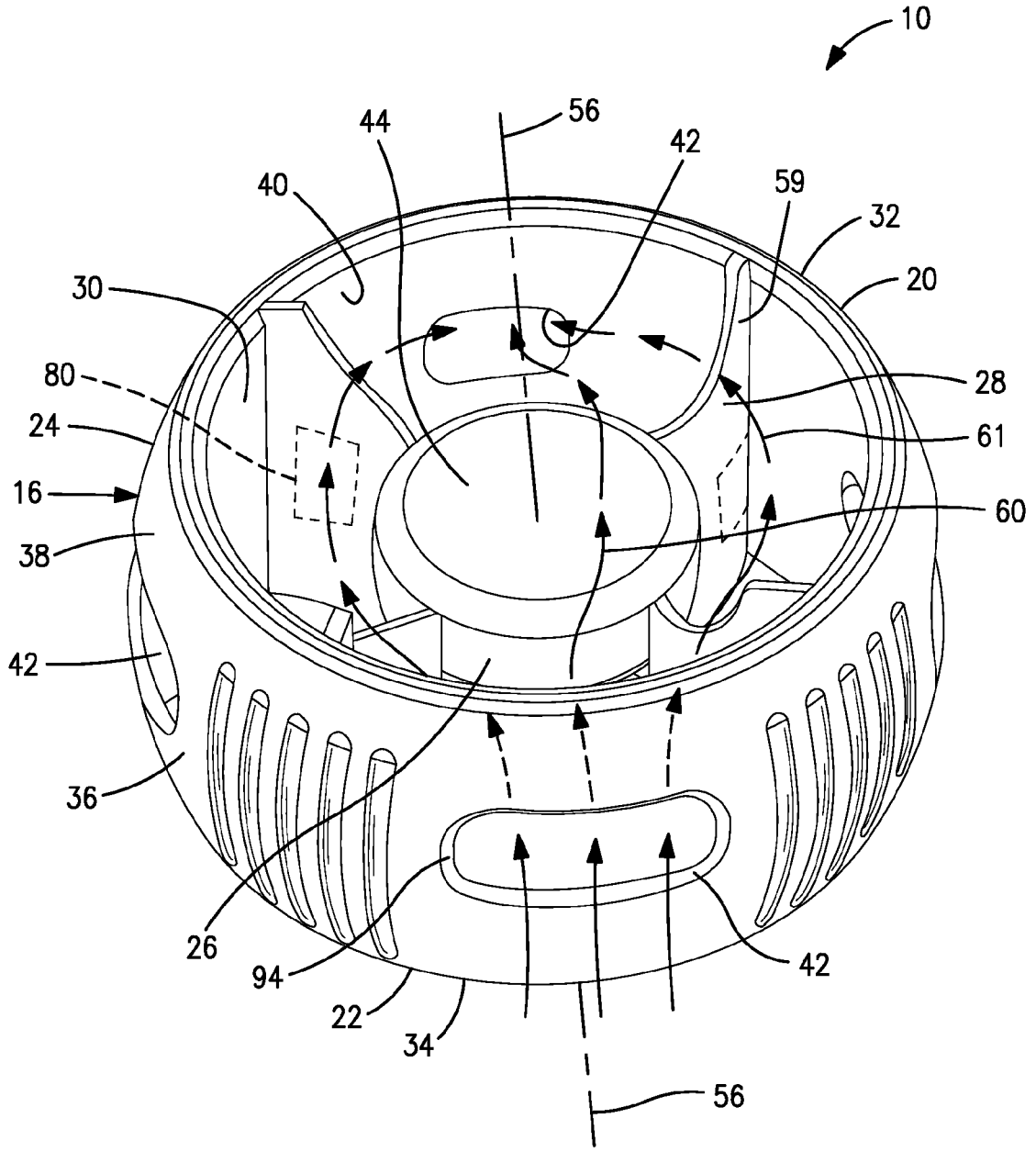
FIG. 5 is a top pictorial view of the cap of FIG. 2.
Figure 6:
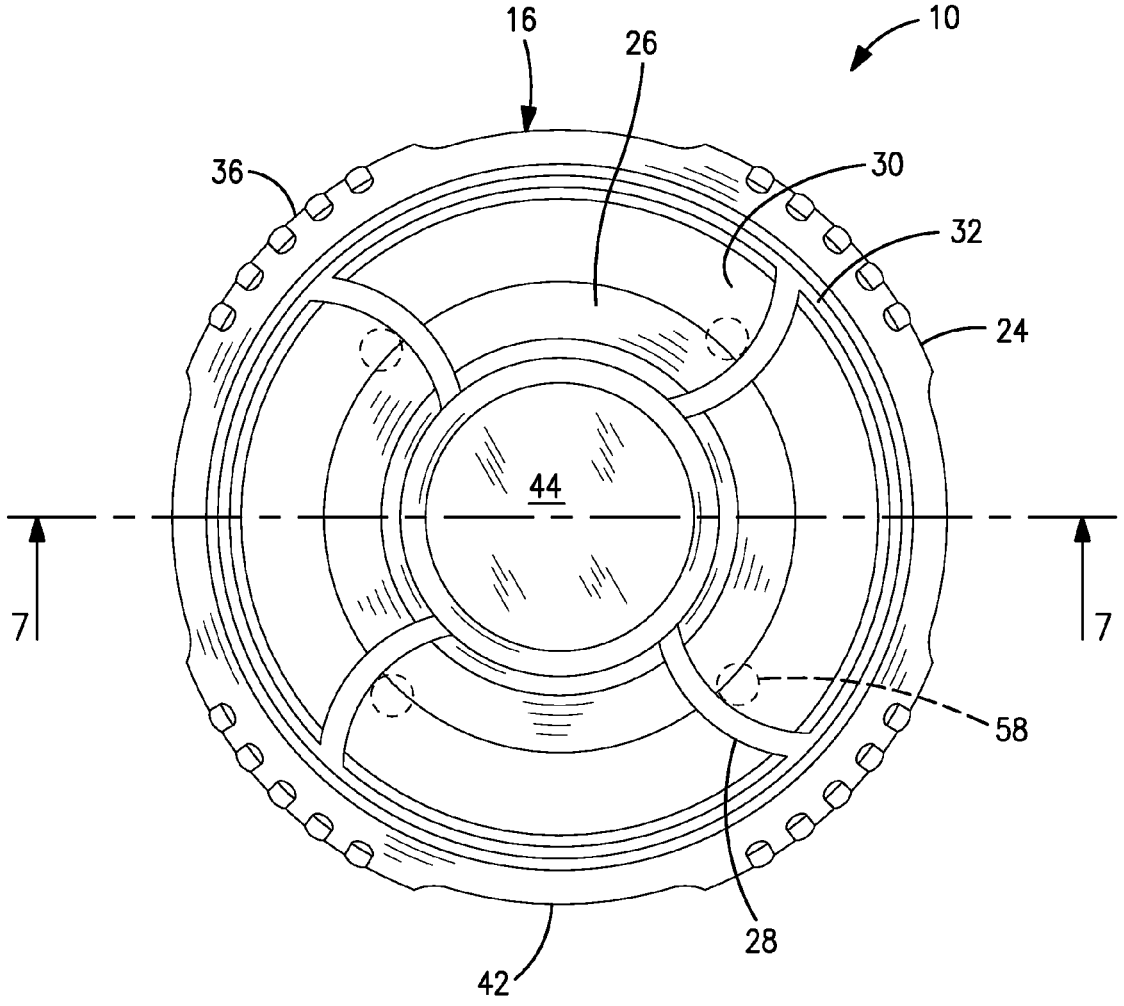
FIG. 6 is a top plan view of the cap of FIG. 5.

In the embodiments illustrated in FIGS. 5 and 7, the tops 59 of tongues 28, and top 44 of inner wall 26, are recessed downwardly from the top of outer wall 24, thus defining an air flow path across an interior portion of the cap, illustrated as 60 in FIGS. 5 and 7. Air can thus enter the cap through a first one of openings 42 on a first side of the cap, can flow across the cap, optionally across the tops of one or more tongues 28, and across the top of the inner wall, to an opposite side of the outer wall, and can leave the cap through a second opening 42 on the opposite side of the cap.

Figure 2:
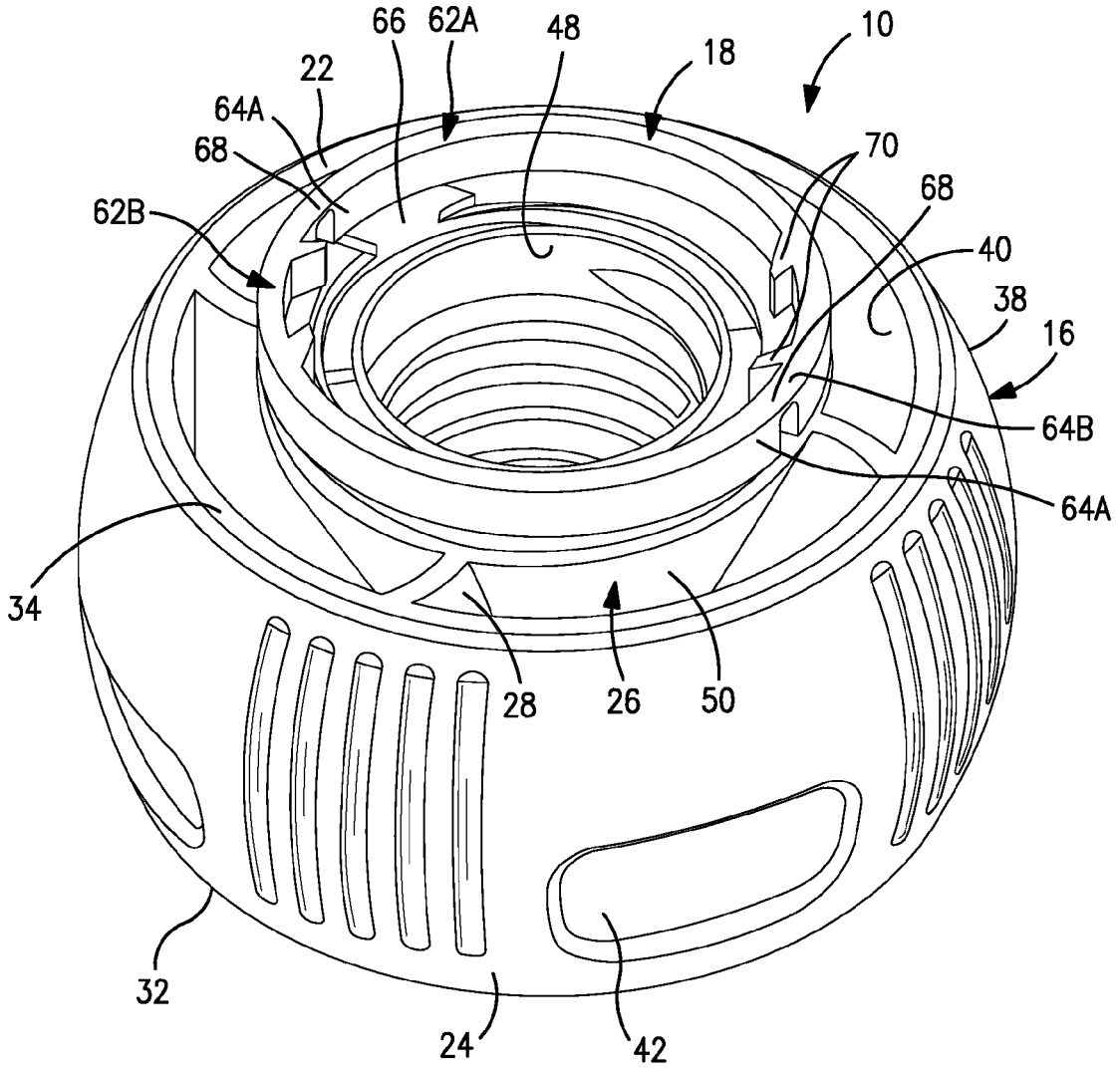
FIG. 2 is a bottom pictorial view of a cap of the invention.

Referring now to FIGS. 2 and 3, tamper evident ring 18 as illustrated, also made of plastic, has a first ring element 62A and a second ring element 62B. Ring elements 62A and 62B, in the illustrated embodiment, collectively encompass the full circumference of tamper evident ring 18. As desired, ring 18 can have as few as a single ring element, or as many ring elements as desired, for example 3 ring elements, 4 ring elements, 5 ring elements, 6 ring elements, or more. Each ring element has a first end 64A proximate a ring retaining tab 66 which is part of the respective ring element, and a second opposing end 64B which is remote from that ring retaining tab 66 which is part of the respective ring element.

Adjacent ones of the ring elements are connected to each other at their respective adjacent ends by frangible intra-ring circumferentially-extending connecting bridges 68. Adjacent each bridge 68, and remote from the retaining tab 66 which is identified with that ring element, is a first, and optionally a second, engagement finger 70 having an engagement surface 71 configured to engage a resisting element on the coupling portion of the respective container 14. Engagement finger 70 extends inwardly from the main body of the ring element toward inner surface 48 of inner wall 26 and toward central longitudinal axis 56 of the cap.

As illustrated, the respective ring element is attached to the cap body by a single ring retainer tab 66, which is remote from the engagement fingers on that respective ring element. And each bridge 68 is adjacent one of the ring retainer tabs.

As illustrated in FIGS. 3 and 7, the outer surface 50 of inner wall 26 has an annular outer perimeter which is greater in cross-section, generally a greater diameter, than the annular outer perimeter of tamper evident ring 18. Accordingly, to the extent ring 18 is subjected to any axial loading imposed from below the bottom of the cap, the bottom of inner wall 26 provides back-up support for ring 18, in order that frangible bridges 68 of ring 18 not be prematurely broken.

Cap 10 is mounted on a receptive portion/coupling of a container by rotating the cap e.g. clockwise when viewed from the top of the cap, about longitudinal axis 56 when in contact with receptive portion/coupling 12, thus engaging threads 52 (FIG. 7) at the inner surface of the inner wall with receptive thread elements on e.g. coupling 12 on the container and correspondingly rotating engagement fingers 70 on the cap past resistant elements on the coupling/container, causing the tamper evident ring to expand radially at the engagement fingers.

The cap is disconnected from the container/coupling by rotating the cap in the opposite, e.g. counterclockwise, direction. As the cap is rotated in the opposite direction, the engagement fingers 70 on the cap engage the resistant elements on the coupling/receptive portion of the container such that the tamper evident ring is prevented from rotating with the cap. The resistance between fingers 70 and the resistant elements on the coupling is stronger than bridges 68. Accordingly, as the cap is rotated, one or more of bridges 68 breaks, and engagement fingers 70 on the retaining ring are released from the resistant elements on the container.

Figure 4:
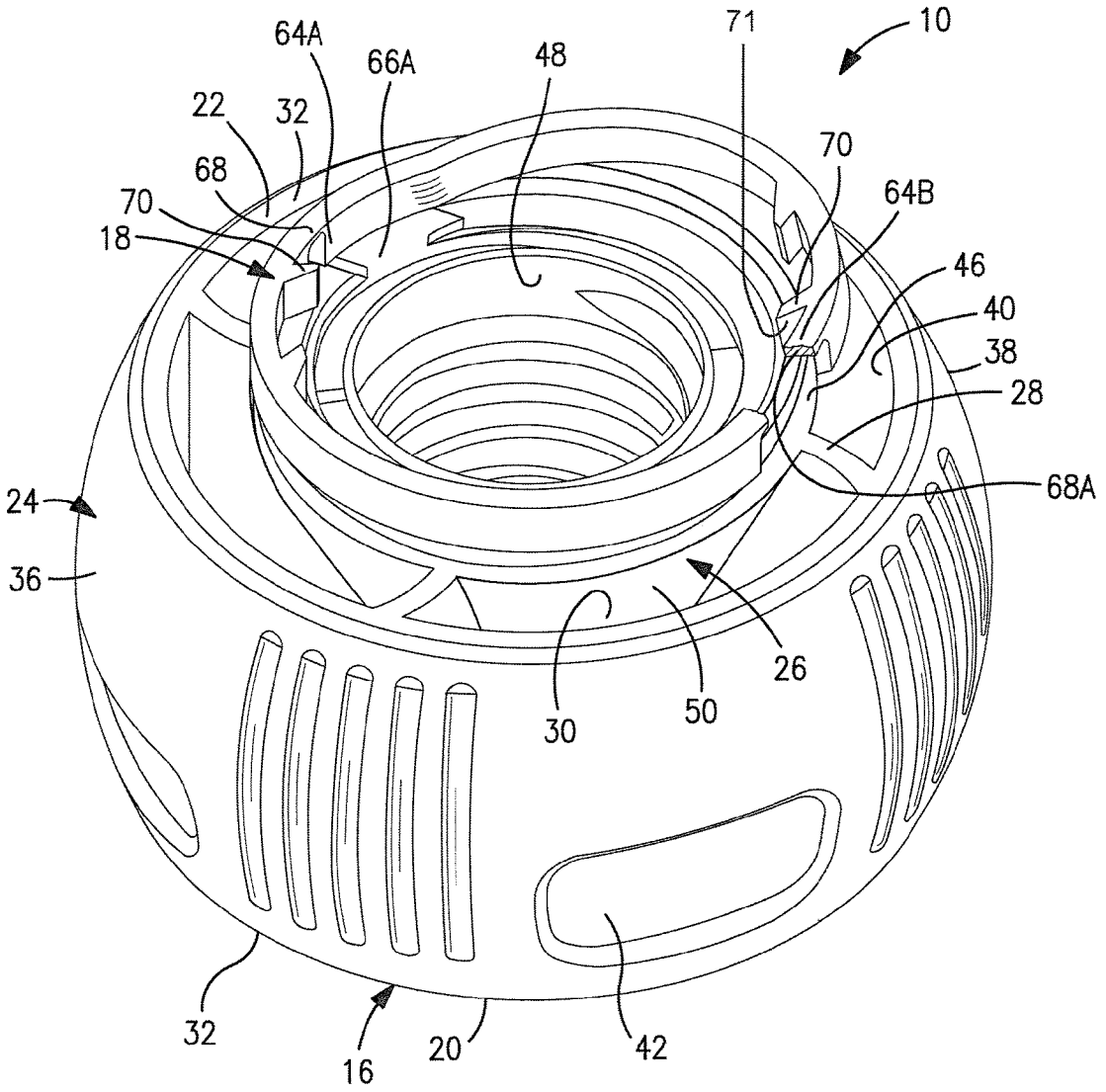
FIG. 4 is a bottom pictorial view as in FIG. 2, after the tamper evident ring has been broken.

As the cap is further rotated, a continuing lower level of resistance between the now-broken-away retaining ring element and the coupling elements typically draws the broken portion of the retaining ring away from the bottom of the inner wall as illustrated in FIG. 4, providing a clear visual indicator that the ring has been broken, that the seal between cap and container has been breached, that the container contents are no longer preserved in their "sealed-container" condition. FIG. 4 illustrates that the ring element which has been "broken" at bridge 68A is retained on the cap by the connection between the ring and the cap at retaining tab 66A.

Thus, when the cap is disconnected from the container, and a bridge breaks leaving opposing adjacent ends of the respective ring elements containing remnants of the broken bridge, one end of broken bridge is on a ring retainer end which is proximate a ring retaining tab and the other end of the broken bridge is on a ring retainer end which is sufficiently remote from all ring retaining tabs, on the respective ring element, that no ring retaining tab precludes movement of the respective ring element end relative to a remainder portion of that respective ring element. Accordingly, the remote, non-attached, ring element end (e.g. 648 in FIG. 4) can protrude from the bottom of the cap body by substantially the full length of the ring element. Such protruding of the ring element from the cap body enhances the difficulty of swallowing the cap, thereby reducing the risk of the cap being swallowed.

As illustrated in e.g. FIGS. 3 and 4, the only connection between a given one of the ring elements and the cap body is a single ring retaining tab 66 which connects each ring element, and thus a portion of the ring, to the bottom 46 of inner wall 26 of the cap. Accordingly, caps of the invention have no need for, and generally do not have, any frangible links extending in the direction of longitudinal axis 56 of the cap.

The industry recognizes the choking hazard presented by detachable e.g. bottle caps. The cap structure illustrated in Bisio 2009/0023963 represents a recent attempt to solve this choking hazard. In the Bisio structure, air can flow through such cap, but only between the top of the cap and the bottom of the cap.

Figure 8A:
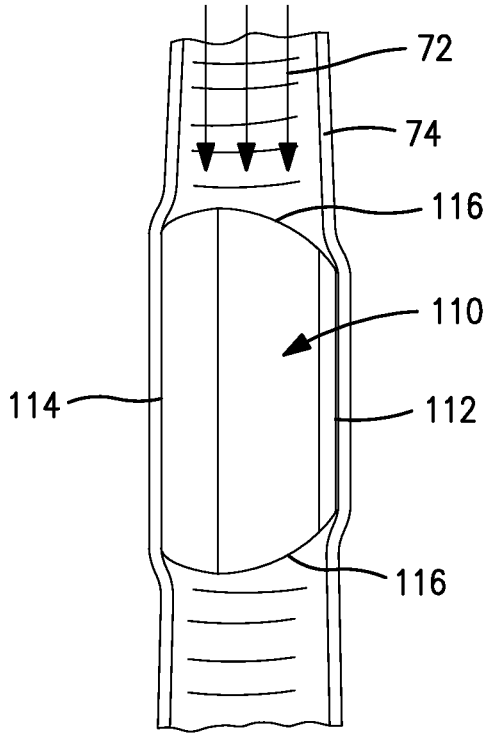
FIG. 8A PRIOR ART
FIG. 8A is a side view of a cap of the conventional art as such cap might appear in a user's throat if the user accidentally swallowed the cap.

However, a cap inhaled into an airway will quickly orient itself to its smallest cross-section in the airway. FIG. 8A illustrates how the cap 110 of Bisio may orient itself, with the top 112 and the bottom 114 of the cap facing opposing sides of the person's airway 74, and the outer wall 116 of the cap facing the directions of desired air flow in the airway. Given the lack of openings in the outer wall of the Bisio cap, no air flows through the cap, whereby the airway remains blocked as indicated by the termination of arrows 72 at the e.g. incoming sidewall of the Bisio cap.

Figure 8B:
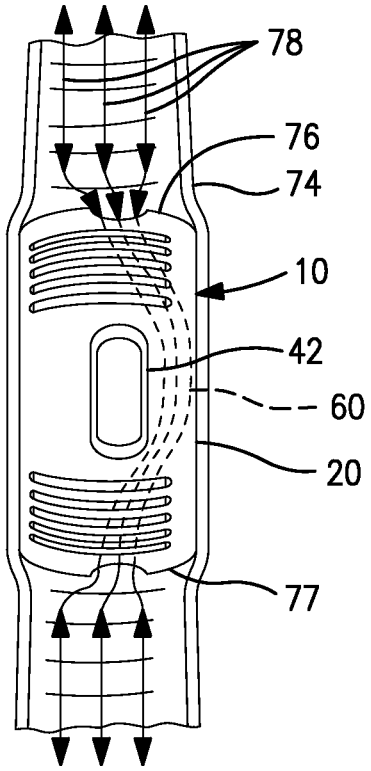
FIG. 8B is a side view of a cap of the invention, incorporating openings in the outer wall of the cap, as such cap might appear in a user's throat if such user accidentally swallowed the cap.

FIG. 8B illustrates a cap of the invention in the same type of airway 74, but where the cap 10 of the invention has openings 42 in the outer wall of the cap, and an air flow path 60 across the cap. Air can enter the cap through one of the openings 42 in the outer wall on a first side 76 of the cap, can flow toward the top 20 of the cap body along air flow path 60, across the top of the inner wall, can flow down to an opening 42 in the outer wall on the opposite side of the cap, and can leave the cap through such opening 42 on the second opposing side 77 of the cap. Arrows 78 illustrate the general path of such air flow. Arrows 78 are shown with heads on both ends of the arrows to indicate that air can flow through the cap, and thus through the airway, in both directions, both for inhaling and for exhaling.

FIGS. 5 and 7 illustrate the air flow path as passing over the top of inner wall 26 and optionally over the tops of connecting tongues 28.

As a second option, the top of the inner wall may be at the same elevation as the top of the outer wall. In such instance, the air flow path extends around the inner wall and over the tops of the connecting tongues 28 as suggested by arrows 61 in FIG. 5.

As a third option, apertures may be provided in the connecting tongues, between the tops and the bottoms of the respective tongues. Exemplary locations of such apertures are shown in dashed outline at 80 in FIG. 5. With such apertured tongue structure, the locations of the tops of the tongues, and the location of top 44 of inner wall 26, become non-critical factors in defining an air flow path. Rather, air can flow into the cap at an opening 42 as in the illustrated embodiments. The air can then flow around the inner wall through the apertures 80 in the tongues, to the opposite side of the cap and out a second opening 42 in the opposite side of the cap as is used in the earlier illustrations. Such apertures through tongues 28 thus assist in creating an air flow path around inner wall 24 rather than over the top of the inner wall or over the tops of the tongues. If the inner wall and/or the tops of the tongues are also recessed from the top of the cap, such define additional, parallel, elements of the air flow path through cap 10. The result is increased ease of passing air through cap 10, assuming enough air flow capacity through the respective effected openings 42 to accommodate the needed volume of air flow.

For convenience of illustration, FIGS. 1-8 have shown the cap with four openings 42 generally evenly spaced about the perimeter of the outer wall. And all of the openings 42 have been confined between the upper and lower edges of the outer wall.

Figure 9:
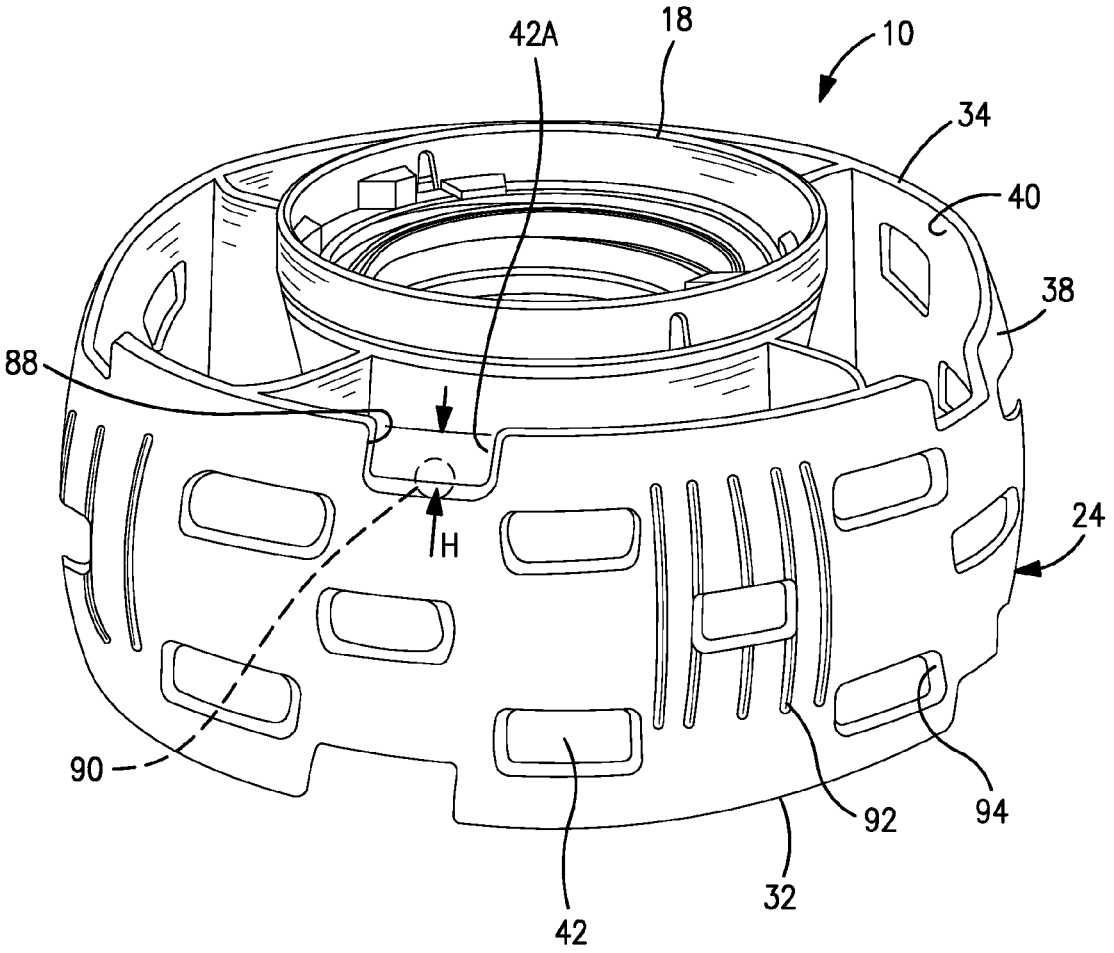
FIG. 9 is a bottom pictorial view as in FIG. 2, showing a second embodiment of the cap, having a greater number of breathing openings than shown in the embodiments of FIGS. 1-8.

FIG. 9 shows another embodiment of caps of the invention illustrating a cap having a greater number of openings 42 and wherein some or all of the openings are relatively smaller in open cross-section than those shown in FIGS. 1-8. Some of the openings 42 are extensions of the upper and lower edges of the outer wall, whereby such openings extend down from the top, or up from the bottom, of the outer wall. The heights "H" of such "extension" openings, as measured from the top and/or bottom of the outer wall extend sufficiently far from the respective top or bottom to provide air passage separation from airway tissue and/or airway contents thus to enable passage of air between the inner edges of such extension opening and such airway tissue and/or airway contents.

By increasing the number of openings, and spacing the openings relatively uniformly over a relatively wider radial portion of the perimeter of the outer wall, and a greater top-to-bottom portion of the outer wall, namely over substantially the entire perimeter of the outer wall, and the entire height of the outer wall, top to bottom, the cap of FIG. 9 provides an enhanced probability that one or more openings 42 on each of the opposing sides of the cap which face along the longitudinal axis of the airway will not be blocked either by airway tissue, or by other airway contents.

Accordingly, the opening configuration of the cap illustrated in FIG. 9 provides enhanced prospect that, if such cap is accidentally swallowed, whatever the ultimate lodged orientation in the airway, enough openings 42 and/or passages 30 will face the air flow path in the airway that the person can still breathe enough air, get enough oxygen, to at least temporarily sustain life until the cap can be removed by medical personnel.

Openings 42 have so far been discussed earlier herein with respect to enabling air flow in a person's airway after the person has swallowed the cap. To that end, a minimum cross-section of about 20 $mm^2$ is believed to be desirable at each the incoming-air side of the cap, through the cap on the cross-cap path, and at the outgoing-air side of the cap. Such opening size can be embodied in a single opening at e.g. the incoming-air side, or in multiple such operative openings as in the embodiment of FIG. 9. It is believed that less than 20 $mm^2$ open cross-section may be sufficient to at least temporarily sustain life until emergency medical assistance arrives, and any such opening size is contemplated to be part of the invention so long as life can be at least temporarily sustained. However, a larger opening, such as about 22 $mm^2$ to about 50 $mm^2$, optionally about 22 $mm^2$ to about 40 $mm^2$, optionally about 24 $mm^2$ to about 30 $mm^2$, is believed to be more typically desirable.

Caps of the invention, and the packages to which such caps are mounted, may be subjected to substantial handling throughout the expected use life of such caps and packages. Thus it is important that the caps, and the packages to which such caps are mounted, are designed for ease of handling. Commercially available samples of caps of the prior art, such as those used with retort pouches, namely caps believed to be available under the Bisio application, have a smooth outer surface texture which facilitates removal of such cap from a mold which makes such cap.

As indicated earlier herein, caps of the invention can be used to close a wide variety of types of packages. Such packages include, without limitation, bottles, juice boxes, plastic and metal cans, bags, squeezable tubes, and pouches including retort pouches. Some such packages, for example, bags and retort pouches, are more easily handled, lifted, moved, transported, by engaging the cap, which has a relatively rigid body, as compared to the body of the pouch or bag which is relatively more flexible.

Engaging the cap may entail engaging the bottom edge of the cap, such that the cap, and thus the package, is retained on the lifting surface by gravity. In the alternative, engaging the cap may entail engaging the outer surface of the cap such as a squeezing engagement, such that the cap, and thus the package, remains engaged with the lifting surface by friction. In a third alternative, engaging the cap may entail engaging both the bottom of the cap and the outer surface of the cap, such that the cap, and thus the package, is retained on the lifting surface/device by a combination of gravity and friction.

Referring to the drawings, openings 42 which extend to the bottom of the cap, for example opening 42A in FIG. 9, provide side walls 88 which can assist in retaining an e.g. lifting finger 90 in the opening. Thus, an opening 42A at the bottom of the cap can assist in transverse positioning of the finger relative to the cap with respect to gravity retention of the cap on the finger.

Turning now to the frictional engagement, the outer surface of the cap has an overall surface texture which is readily gripped by a person's finger using minimum-to-moderate manual effort. In addition, a plurality of sets of raised ribs 92 are spaced about the circumference of the cap. As illustrated, each set has 5 ribs. More, or fewer, ribs are contemplated. Each rib protrudes from the base portion of the outer surface, or can be recessed into the base portion of the outer surface. The dimensions of such protrusion, or recess, are such as to facilitate manual gripping of the cap without the ribs extending so far from the base portion of the outer surface as to interfere with routine grasping of the cap. A typical protrusion, or recess dimension, from the base portion of the outer surface 38 of outer wall 24, is less than about 2 mm, optionally less than 1 mm, optionally about 0.1 mm to about 0.5 mm, optionally about 0.25 mm. In some embodiments, a recessed elongate rib extends entirely through the outer wall 24, whereby the recessed rib functions both as a recess and as an opening 42.

An additional factor in frictional engagement of the cap is openings 42. Openings 42 have been described so far as air flow conduits. Openings 42 also serve to assist in the frictional engagement of the outer side surface of the cap for the purpose of lifting, moving, transporting, and otherwise handling the cap and/or the finished package.

One property of openings 42 is that a surface 94 facing into an opening 42 serves/functions as a gripping surface when the side of the cap is gripped by a soft gripping interface such as human skin on fingers, foam and/or rubber pads, and the like. Namely, the soft gripping interface deforms against the outer surface of the cap and part of that deforming interface thus deforms/flows into an opening 42, providing a grip interface inside the opening, against a corresponding surface 94. Such gripping interface is effective so long as the opening is large enough to be penetrated to the side surface interface by the soft gripping interface.

The primary load factor exerted on a cap/package, is typically the downward pull of gravity. Accordingly, the most significant surface 94 is at the upper side of an opening 42. Thus, for gripping purposes, the configuration of an opening 42 can be essentially anything so long as two factors are met. First, the perimeter dimension of the opening must be long enough to receive a functional length of the gripping surface. Second, the lower side of the opening must be spaced from the upper side of the opening far enough that a functional mass portion of the gripping surface material can enter and engage the side surface 94 of the opening. In general, minimum dimensions for an opening 42 at the outer surface of outer wall 24 is along about 2 mm circumferential length of the outer wall and about 1 mm spacing between the top of the opening and the bottom of the opening, again at outer surface 38. Where openings 42 are so small, a substantially greater number of openings are required for the purpose of providing for sufficient quantity of air flow capacity through outer wall 24.

In embodiments not shown, ribs 92 can be recessed instead of protruding. In addition, ribs 92 can be oriented horizontally, or at any other angle, instead of vertically; or some ribs 92 can be oriented vertically while other ribs are oriented horizontally or at any other angle. In such combination of vertical and non-vertical ribs, or all non-vertical ribs, some of the ribs may extend across each other, thus to portray a crossing or matrix configuration, optionally a four-sided diamond-shaped, pattern.

Again addressing safety matters, the portions of outer wall 24 which border openings 42 provide engagement surfaces which medical personnel may be able to engage with extraction instruments for the purpose of extracting the lodged cap from a person's airway.

Figure 10:
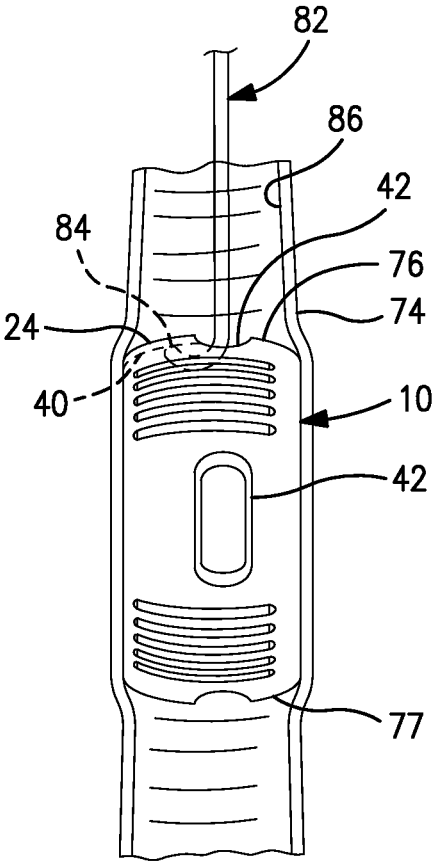
FIG. 10 is a side view of the cap in a user's throat as in FIG. 8B, showing a medical instrument engaged with the cap, so as to extract the cap through the airway of the patient.

For example, FIG. 10 illustrates the use of a hook, or other medical instrument 82, such as a forceps, thus to engage inner surface 40 of outer wall 24 through one of openings 42. Thus, the design and structure of cap 10 allows a physician to insert the instrument, through the patient's mouth, into the patient's airway. The instrument is extended along the elongate length of the airway to the lodged cap 10. The distal end 84 of the instrument is then inserted into one of the openings 42 which extend through the outer wall of the cap.

The distal end element, or elements, of the instrument is/are then engaged with the inner surface of the outer wall, as illustrated for e.g. a hook, in FIG. 10. With the instrument so engaged with the inner surface of the outer wall, the physician can pull, and otherwise urge the cap toward the patient's mouth opening. If necessary, the wall 86 of the airway can be dilated, stretched, ahead of the advancing cap in order to make the airway large enough that the cap can be advanced, ultimately extracted, through the patient's mouth without unnecessarily tearing, abrading, or otherwise further injuring the airway tissue.

Thus, a feature of the invention is a method of extracting/removing a cap from the airway of a person who has accidentally swallowed such cap. Such method includes an e.g. physician inserting an instrument through the person's mouth into the airway, and along the length of the airway to the cap. The distal end of the instrument is inserted through an opening in the cap and the end of the instrument is engaged with an inner surface of a wall of the cap. With the end of the instrument engaged with the inner surface of the wall of the cap, the physician gently pulls the cap along the airway and into the patient's mouth, then out of the mouth, thus out of the person. As needed, the physician separately expands the cross-section of the airway to facilitate passage of the cap through the airway.

According to the invention, a packager of e.g. food or drink, or other, products can reduce the risk of a user swallowing a cap by using a cap which is sufficiently large that the cap is hard to swallow. The dimensions selected for a particular cap represent a balance among factors such as amount of material used, cost to produce, ease of handling, reduced potential for ability to be swallowed, and the like. Of course, if such cap is over-engineered toward safety, it may be so costly that no one will purchase such cap, whereby the safety objective is overwhelmed by market rejection. For example, if the cap was made so large as to be impossible to swallow, such cap would use a relatively greater quantity of material; production cost would be high, and/or the cap might be difficult to handle. To that end, caps of the invention have overall height, top to bottom, of about 12 mm to about 25 mm, optionally about 14 mm to about 20 mm, optionally about 16 mm; and overall transverse dimension, e.g. diameter, of about 25 mm to about 50 mm, optionally about 25 mm to about 40 mm, optionally about 30 mm.

While size can be a factor in reducing the risk of death or severe damage due to swallowing a cap, and subsequently being unable to breathe, the risk of severe permanent harm due to swallowing a cap, and subsequently being unable to breathe, can be further reduced by using caps of the invention which incorporate side openings 42 as well as top-to-bottom passages 30 such that, even if a cap is swallowed, air can still pass through the person's airway, including through the cap, until the situation can be remedied by skilled medical personnel.

Thus, a package can be designed to reduce risk of severe permanent harm by employing, on such packages, caps of the invention having both openings 42 and passages 30.

The components of cap 10 are made with generally rigid plastic, whereby the entire cap, including the tamper evident ring, where used, can optionally be injection molded as a unitary element.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A cap adapted to be mounted to a receptive portion of a container, said cap having a top and a bottom, and comprising:

(a) a cap body, comprising
  (i) an inner wall, and
  (ii) an outer wall extending about said inner wall;
(b) a tamper evident ring proximate the bottom of said cap; and
(c) at least a first axial passage extending entirely through said cap, from the top of said cap to the bottom of said cap, said outer wall having a top and a bottom, and an inner surface and an outer surface, and wall thicknesses between the inner surface and the outer surface, further comprising a plurality of openings extending between the inner and outer surfaces of said outer wall and being bounded on all sides by said outer wall, the plurality of openings defining passages which are displaced from the top of said outer wall, and which convey air between the inner and outer surfaces of said outer wall, and wherein the thickness of said outer wall at a top of a respective such opening is representative of a generally constant thickness about an entirety of a circumference of said outer wall at the respective distance from the bottom of said outer wall.

2. A cap as in 1, further comprising a cross-cap path across said cap enabling air to flow between one or more of the openings in said outer wall on a first side of said cap, along the cross-cap path to respective one or more of the openings in said outer wall on a second side of said cap, such that air can flow through said cap by entering said cap through a first such opening in said outer wall on the first side of said cap, flowing along the cross-cap path across said cap, and leaving said cap through a second such opening in said outer wall at the second side of said cap.

3. A cap as in claim 1, further comprising at least one connector connecting said outer wall and said inner wall to each other, and an aperture bounded on all sides by, and extending through, at least one said connector.

4. A cap as in claim 1 wherein sizes and spacings of the openings through said outer wall, in combination with a cross-cap path across said cap, collectively, conveys such volume of air at breathing pressure as to enable a person, who may have swallowed said cap, to at least temporarily breathe enough air through such openings and along the cross-cap path, and thus through said cap, to at least temporarily sustain life.

5. A cap as in claim 3, said at least one connector having a connector top disposed toward the top of said cap, and a cross-cap path, at least a portion of the cross-cap path passing over the top of said at least one connector.

6. A container, comprising an inner receptacle, a coupling connected to said receptacle, and a cap as in claim 1 mounted to said coupling and thereby closing off said receptacle from the ambient environment.

7. A cap adapted to be rotated about a longitudinal axis thereof as said cap is being mounted to a receptive portion of a container, said cap having a cap top and a cap bottom, and comprising a cap body having a body top and a body bottom, said cap comprising (a) an outer wall, (b) an inner wall, having a wall top and a wall bottom, and a wall height between the wall top and the wall bottom, a first outer surface, and a first inner surface, the inner surface of said inner wall having threads which define a thread-engaging portion of the inner surface, the thread-engaging portion of the inner surface having a top and a bottom, said inner wall extending between the bottom of said cap and the top of said cap, said outer wall extending about said inner wall, said inner wall having a wall thickness comprising a first radially-extending thickness increment (T1), of constant magnitude, extending from the top of said inner wall to the bottom of said inner wall, said first thickness increment, less any threads, defining a constant thickness which extends from the inner surface of said inner wall toward the outer surface of said inner wall along an entirety of a height of the first thickness increment, and wherein the first thickness increment, of constant magnitude, comprises the entirety of the thickness of said inner wall from the top of said inner wall to an intermediate location substantially displaced from the top of said inner wall, said inner wall having a second thickness increment (T2) extending from the inner surface of said inner wall to the and outer surface of said inner wall, the second thickness increment (T2) having a top at the intermediate location, said second thickness increment comprising a first lower wall thickness portion (ΔT1) having a thickness equal to said first thickness increment (T1), plus a second wall thickness portion (ΔT2), the second wall thickness portion (ΔT2) being confined to the second thickness increment (T2) and having a top at the top of said second thickness increment, a bottom at the bottom of said inner wall, and a top-to-bottom height therebetween extending upwardly along at least one third of the top-to-bottom height of said inner wall, the second thickness increment having a thickness magnitude which increases, the thickness magnitude increase starting at the top of the second thickness increment and extending to the bottom of said inner wall, whereby the outer surface of said inner wall, along substantially the entire height of said second thickness increment, is disposed radially outwardly of the outer surface of said inner wall at said first thickness increment, and (c) at least a first connector connecting said outer wall and said inner wall to each other.

8. A cap as in claim 7, the second wall thickness portion (ΔT2) terminating at a height approximately corresponding to the top of the thread-engaging portion of the inner surface of said inner wall.

9. A cap as in claim 7 wherein said second wall thickness portion continually increases in thickness from the top of said second wall thickness portion to the bottom said second wall thickness portion.

10. A cap adapted to be mounted to a receptive portion of a container, said cap having a top and a bottom, and comprising:

(a) a cap body having a top and a bottom, and comprising (i) an inner wall, having a top and a bottom, a first outer surface, and a first inner surface, said inner wall extending directionally between the bottom of said cap and the top of said cap, said inner wall being imperforate between the top of said inner wall and the bottom of said inner wall, (ii) an outer wall spaced from said inner wall, and extending about said inner wall, and (iii) at least a first connector connecting said outer wall and said inner wall to each other;

(b) a tamper evident ring proximate the bottom of said cap body and connected to said cap body; and (c) at least a first axial passage extending entirely through said cap, from the top of said cap to the bottom of said cap, and said outer wall having a top and a bottom, a second inner surface and a second outer surface, and a wall thickness between the second inner surface and the second outer surface, further comprising a plurality of openings extending between the second inner and outer surfaces of said outer wall and bounded on all sides by said outer wall, the plurality of openings defining passages which are displaced from the top of said outer wall which convey air between the inner and outer surfaces of said outer wall, and wherein the thickness of said outer wall at a top of a respective such opening is representative of a generally constant thickness about an entirety of a circumference of said outer wall at the respective distance from the bottom of said outer wall.

11. A container, comprising an inner receptacle, a coupling connected to said receptacle, and a cap as in claim 10 mounted to said coupling and thereby closing off said receptacle from the ambient environment.

12. A cap as in claim 10, said tamper evident ring bearing radially-extending engagement fingers having circumferentially-facing engagement surfaces adapted and configured to engage engagement surfaces on a container to which said cap may be mounted.

13. A cap as in claim 10, said tamper evident ring being connected to said cap body by one or more ring retaining tabs, all of said ring retaining tabs remaining connected to both said cap body and to said tamper evident ring when said cap is disconnected from such receptive portion.

14. A cap as in claim 10, said tamper evident ring comprising at least one ring element, and at least one engagement finger having a circumferentially-facing engagement surface which engages the at least one resistant element on such receptive portion of such container when said cap is disconnected from such receptive portion of such container.

15. A cap as in claim 10, further comprising a tamper evident ring proximate the bottom of said cap body and connected to said cap body.

16. A cap adapted to be rotated about a longitudinal axis thereof in a first forward direction as said cap is being mounted to a receptive portion of a container, said cap being further adapted to be rotated in a second reverse direction when being dismounted from such receptive portion, said cap having a first top and a first bottom, and comprising a cap body having a second top and a second bottom, said cap comprising (a) an outer wall structure, (b) an inner wall structure having a third top, a third bottom, an outer surface, and a first inner surface, said inner wall structure being connected to said outer wall structure by at least one connecting tongue, and (c) a tamper evident ring proximate the bottom of said cap body and connected to said cap body, said tamper evident ring having at least first and second circumferentially-extending ring elements, connected to each other by circumferentially-extending breakable bridges, and at least one engagement finger extending from at least one of said ring elements toward the longitudinal axis, said tamper evident ring having inner and outer surfaces, the outer surface of said tamper evident ring (i) being spaced radially inwardly from the outer surface of said outer wall structure, and (ii) being spaced radially inwardly from the outer surface of said inner wall structure.

17. A cap as in claim 16, each said ring element being connected to said cap body by a single ring retaining element which remains connected to said cap body when said cap is dismounted from such receptive portion of such container.

18. A cap as in claim 16, said tamper evident ring being connected to said cap body by one or more ring retaining tabs, all of said ring retaining tabs remaining connected to both said cap body and said ring when said cap is disconnected from such receptive portion.

19. A cap as in claim 16, said tamper evident ring comprising said at least one engagement finger which extends radially to the second engagement surface on such receptive portion of such container when said cap is being dismounted from such receptive portion of such container.

20. A cap as in claim 19, further comprising a ring retaining tab (66), at least a portion of said ring retaining tab extending axially from said tamper evident ring to said inner wall.

21. A container, comprising an inner receptacle, a coupling connected to said receptacle, and a cap as in claim 16 mounted to said coupling and thereby closing off said receptacle from the ambient environment.

22. A cap as in claim 16, said tamper evident ring being devoid of any connection directly to said at least one connecting tongue.

23. A cap as in claim 16, a said circumferentially-extending ring element being connected to said cap body, when said cap is disconnected from such receptive portion of such container, by a single ring retaining tab.

24. A cap adapted to be rotated about a longitudinal axis thereof in a first forward direction when being mounted to a receptive portion of a container, said cap being further adapted to be rotated in a second reverse direction when being dismounted from such receptive portion, said cap having a cap top and a cap bottom, and comprising a cap body having a body top and a body bottom, said cap comprising:

(a) an outer wall;

(b) an inner wall, having a wall top and a wall bottom which defines a wall height therebetween, a first outer surface, and a first inner surface, the inner surface of said inner wall having threads which define a thread-engaging portion, the thread-engaging portion of the inner surface having a top and a bottom, said inner wall extending directionally between the bottom of said cap and the top of said cap, said outer wall extending about said inner wall, said inner wall having a wall thickness, a first portion of a height of said inner wall having a first wall thickness increment which extends from the top of said inner wall to an intermediate location proximate the top of the thread-engaging portion of the inner surface, and which first thickness increment extends from the first inner surface to the first outer surface, and which first thickness increment has a constant top-to-bottom thickness from the first outer surface to the first inner surface, a second portion of the height of said inner wall having a second wall thickness increment having a top proximate the top of the thread-engaging portion of the inner surface, and a bottom at the bottom of said inner wall, the second wall thickness increment having a thickness which varies in magnitude proximate the top of said second wall thickness increment and having a thickness at the bottom of said inner wall greater than a thickness thereof at the top of the second thickness increment; and (c) at least a first connecting tongue connecting said outer wall and said inner wall to each other.

25. A cap as in claim 24 wherein the thickness of said second wall thickness increment increases in magnitude, increasing constantly from the top of said second wall thickness increment to the bottom of said inner wall.

26. A container, comprising an inner receptacle, a coupling connected to said receptacle, and a cap as in claim 7 mounted to said coupling and thereby closing off said receptacle from the ambient environment.

27. A container, comprising an inner receptacle, a coupling connected to said receptacle, and a cap as in claim 24 mounted to said coupling and thereby closing off said receptacle from the ambient environment.

* * * * *